US006279473B1

(12) United States Patent
Schneider et al.

(10) Patent No.: US 6,279,473 B1
(45) Date of Patent: Aug. 28, 2001

(54) INKER UNIT

(75) Inventors: Georg Schneider; Willi Albert Peter Kutzner, both of Würzburg; Wolfgang Otto Reder, Veitshöchheim, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/423,320

(22) PCT Filed: May 11, 1998

(86) PCT No.: PCT/DE98/01309

§ 371 Date: Nov. 8, 1999

§ 102(e) Date: Nov. 8, 1999

(87) PCT Pub. No.: WO98/51500

PCT Pub. Date: Nov. 19, 1998

(30) Foreign Application Priority Data

May 9, 1997 (DE) ..... 197 19 560

(51) Int. Cl.[7] ..... B41F 31/00; B41F 1/40

(52) U.S. Cl. ..... 101/350.2; 101/352.04

(58) Field of Search ..... 101/350.2, 351.1, 101/351.3, 352.01, 352.04, 209

(56) References Cited

U.S. PATENT DOCUMENTS

| | | | | |
|---|---|---|---|---|
| 2,751,843 | | 6/1956 | Faeber . | |
| 3,538,849 | * | 11/1970 | Bohman | 101/349 |
| 4,625,642 | | 12/1986 | Despot et al. . | |
| 5,134,934 | * | 8/1992 | Knauer et al. | 101/143 |
| 5,142,977 | * | 9/1992 | Gertsch et al. | 101/148 |
| 5,201,271 | * | 4/1993 | Pierre | 101/350 |
| 5,341,733 | | 8/1994 | Weisbrod . | |
| 5,448,949 | * | 9/1995 | Bucher | 101/216 |
| 5,485,785 | | 1/1996 | Schneider et al. . | |
| 5,603,262 | | 2/1997 | Uera et al. . | |

FOREIGN PATENT DOCUMENTS

| | | |
|---|---|---|
| 1214704 | 4/1966 | (DE) . |
| 3545720 A1 | 6/1987 | (DE) . |
| 3906648 A1 | 10/1989 | (DE) . |
| 4232163 C2 | 6/1995 | (DE) . |
| 19535266 A1 | 4/1997 | (DE) . |
| 18907 | 6/1915 | (GB) . |
| 48-89010 | 11/1973 | (JP) . |
| 61-120754 | 12/1986 | (JP) . |
| 5-502825 | 8/1994 | (JP) . |

* cited by examiner

*Primary Examiner*—Kimberly L. Asher
(74) *Attorney, Agent, or Firm*—Jones, Tullar & Cooper, PC

(57) ABSTRACT

An inker unit for a printing unit of a web-fed rotary printing press has a pair of ink application rollers in direct contact with a forme cylinder and with a central, ink receiving roller. A pair of inking rollers are also in direct contact with the ink receiving roller, and in indirect contact with the ink application rollers through riding rollers. The ink application rollers are thus inked both directly and indirectly from the ink receiving roller.

19 Claims, 4 Drawing Sheets

S

INKER UNIT

FIELD OF THE INVENTION

The present invention relates to an inking system for a printing unit of a web-fed rotary printing press. The inking system uses ink application rollers that are directly inked by a central, ink conducting roller. These ink application rollers are also indirectly inked a second time by an ink roller train that originates with the central ink-conducting roller.

DESCRIPTION OF THE PRIOR ART

A prior art short inking system for a rotary printing press is known from GB-PS 18 907 and DE 195 35 266 A1. The following steps are provided in this prior art device for improving the ink application to a forme cylinder:

- a first ink application roller has a lesser diameter than the forme cylinder,
- a first ink transfer roller or riding roller is placed against the first ink application roller,
- The first ink transfer roller or riding roller is in contact with a further inking system roller,
- this further inking system roller is an inking roller which is placed against a central inking roller—in this case a riding roller, for example—,
- wherein, in relation to the direction of rotation of the central inking roller, the further inking system roller is in contact with the central roller ahead of the first ink application roller.

DE 35 45 720 A1 shows a short inking system with a screen roller wherein, with non-screened full surface printing, it is intended to achieve good ink coverage. To this end, the same principle of ink application, as with the above mentioned references GB-PS 18 907 and DE 195 35 266 A1, is applied. Two ink application rollers are employed, both of which are in contact with a screen roller. Following the transfer of ink by means of the first ink application roller to a first roller, the remaining ink application is transferred to an ink application roller in accordance with the ink splitting principle. The latter than transfers the ink to the first roller.

An inking system with two ink application rollers, one side of which can be brought into contact with a forme cylinder, is described in U.S. Pat. No. 2,751,843. On the other side, the two ink application rollers are in contact with a central inking roller. The ink application rollers are seated in spring-loaded rockers. The ink application rollers are seated in these spring-loaded rockers so that their position can be better matched to the contour of the forme cylinder.

SUMMARY OF TH INVENTION

The object of the present invention is based on providing an inking system for a rotary printing press.

In accordance with the invention, this object is attained by the provision of an inking system that uses a central ink-conducting roller to supply ink to ink application rollers. Ink may be supplied in both a direct path and an indirect path from the ink-conducting roller to the ink application roller or rollers. The ink application roller or rollers may be supported for movement into and out of contact with a forme cylinder.

The advantages to be gained by the present invention consist in particular, in that:

It is possible to provide the inking system with a low structural height and with the application of chamber doctor blades or doctor blade devices directly on a central inking roller which "distributes" ink, even with a short structural length.

It is possible to arrange several, for example two, inking roller trains, each of which is provided with a plurality of inking rollers, from the central inking roller, each of which provide an ink application to a common forme cylinder.

It is possible, in a simple manner, to generate a multitude of different ink separation options by changing the contact of the inking rollers with each other, or with the central inking roller.

By the placement of the plurality of inking rollers in a plurality of pairs of rockers, it is possible to adjust the plurality of the inking systems easily and rapidly, in spite of the restricted spatial conditions; i.e. the very close arrangement of the inking systems and printing units. The operator can reach each roller without contortions. In a particularly advantageous manner, it is possible to pivot each inking roller train by itself in such a way that the operator practically has all of the inking rollers of the respective inking roller train "in front of his stomach".

Thus, with small space requirements, it is possible to house a relatively large number of inking rollers. It is possible, by means of the selective placement of inking rollers against the central inking roller, and by means of bringing the inking rollers into and out of contact with each other, to selectively change the thickness of the ink layer to be applied to the forme cylinder.

BRIEF DESCRIPTION OF THE DRAWINGS

Preferred embodiments of the present invention are represented in the drawings and will be described in greater detail in what follows. Shown are in.

DESCRIPTION OF THE PREFERRED EMBODIMENTS

Figure 1:
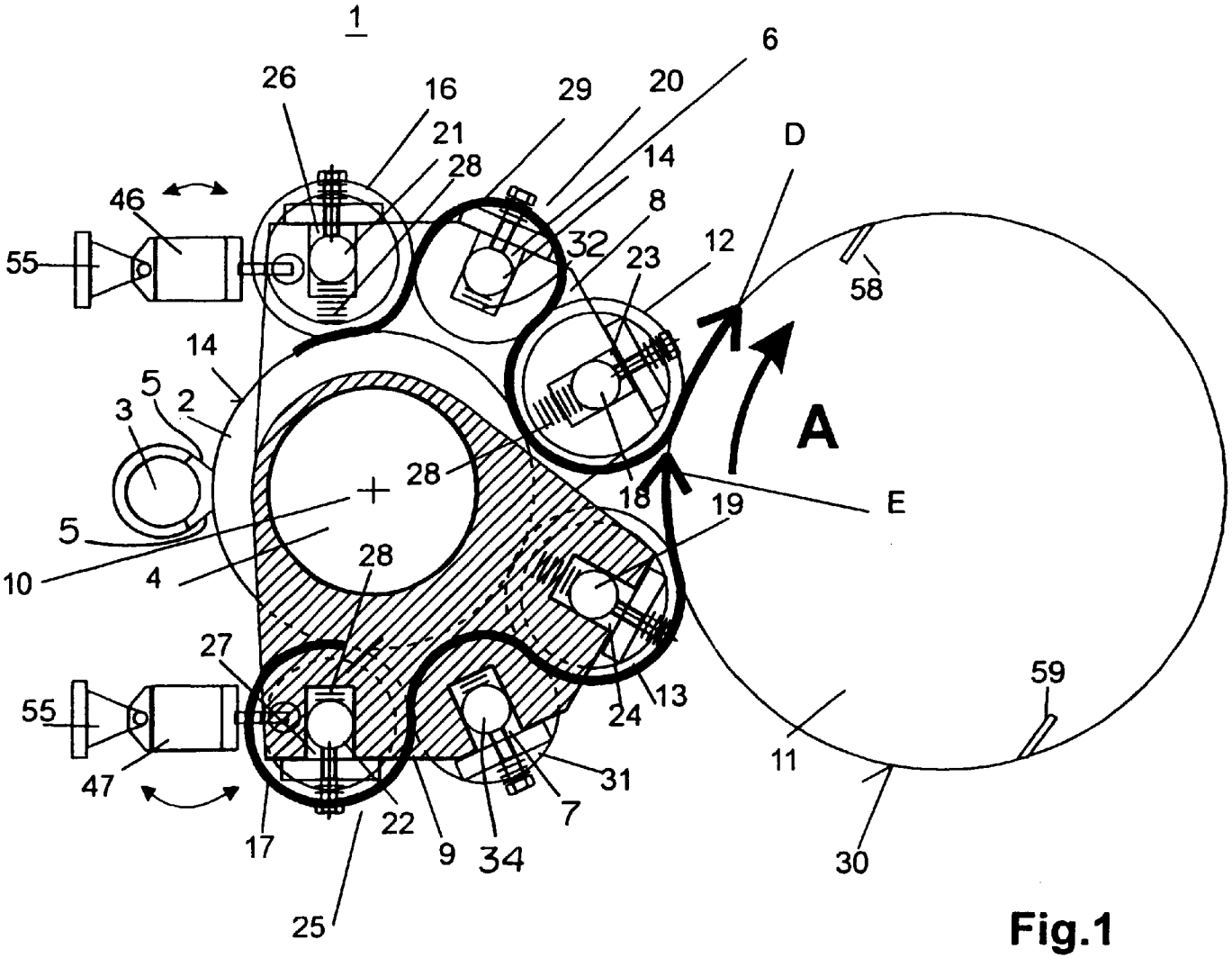
FIG. 1, a side elevation view of a schematic representation of an inking system in accordance with the present invention, which inking system has been placed against a forme cylinder and is providing a first ink flow bypass D and a second ink flow bypass E, FIG. 2, a representation analogous to FIG. 1, but with an inking system with a second riding roller placed on the ink application roller, FIG. 3, a representation of "work position A", and "servicing position B", and in FIG. 4, a further preferred embodiment of an inking system in accordance with the present invention.

An inking system 1, for example a short inking system of a rotary printing press, essentially consists of an ink application device 3, which places an application of ink onto an ink receiving roller 2, hereinafter called "central roller 2" or "roller 2" for short, as may be seen in FIG. 1. If the central roller 2 is designed as a screen roller, for example, ink is transported in its small cups or hatchings.

In place of the screen roller, however, central rollers 2 of other construction can be employed. For example, they can be provided with a smooth plastic sheath of, for example Rilsan TM, or a different oleophilic, rubber-elastic sheath for example, known from DE 28 12 998 C2, FIG. 3, or a ceramic sheath, for example $Fe_2O_3$, or a sheath of glass. The ceramic or glass sheath can also have indentations, or can have a surface structure produced in another way.

The ink application device 3 can consist, for example, of a doctor blade 5, known per se, or can also consist of several rollers, which are in contact with each other and which receive their ink application, for example, from a conventional ink reservoir or from a pump or an ink spray device, etc. It is also possible to provide several inking roller trains as the ink application device 3.

One or more ink application rollers 12, 13 are in contact with the central roller 2. Ink application roller 12 is part of a first inking roller train 20. Ink application roller 13 is part of a second inking roller train 23, all as seen in FIG. 1. The first inking roller train 20 provides a first ink flow bypass D. The second inking roller train 25 provides a second ink flow bypass E.

In addition to the ink application device 3 and the ink application rollers 12, 13, at least one more inking roller 16, 17 with an oleophilic sheath is in contact with the surface of the roller 2. The inking rollers 16 and 17 are part of the first and second inking roller trains 20 and 25, respectively. Inking roller or rollers 16, 17 can each be designed as a back-and-forth moving inking roller or rollers. The oleophilic sheath of a first riding roller 29, 31 is in contact with each of ink application roller(s) 12, 13, respectively and also with each of the inking roller 16, 17 in the first and second inking roller trains 20 and 25, respectively, as seen in FIG. 1. The riding roller 29, 31 can be designed as a back-and-forth moving roller. Respectively, one second riding roller 38, 39 with oleophilic sheaths can also be placed on the ink application rollers 12, 13 of the first and second inking roller trains 20 and 25, respectively as seen in FIG. 2. The second tiding rollers 38, 39 can be engaged with, or disengaged from the respective ink application rollers 12, 13. The ink application rollers 16, 17 can each be engaged with, or disengaged from, the central roller 2. It is sufficient to drive the rollers 12, 13, 16, 17, 29, 31, 38, 39 of the first and second inking roller trains 25 and 30, respectively by means of friction. However, they can also be driven in other ways, for example by electric drives. Each can be adjusted in respect to its adjoining rollers, or respectively to the central roller 2 to adjust the width or thickness of the ink transfer strips or layers which are applied by the first and second ink roller trains 25 and 30 to the forme cylinder 11.

The upper inking system rollers 16, 29, 12 constitute the first inking roller train 20. The lower inking system rollers 17, 31, 13 constitute the second inking roller train 25. These two inking roller trains 20, 25 are each respectively supplied with ink from the central roller 2, via each of the first inking system rollers 16, or respectively 17, and additionally via each of the first ink application rollers 12, or respectively 13. However, it is also possible to keep one or the other of the ink application rollers 12, 13 out of contact with the central roller 2. In this case the ink flow would be as follows:

a) the upper or first inking roller train 20 from the roller 2->the inking roller 16->the riding roller 29->the ink application roller 12, and/or b) the lower or second inking roller train 25 from the roller 2->the inking roller 17->the tiding roller 31->the ink application roller 13.

However, it would also be possible for only the upper inking roller train 20 to be switched in, and the lower inking roller train 25 to be switched off. To this end, the inking roller 16, or respectively 17, would have to be brought out of contact with the roller 2.

Further possibilities of affecting the printing ink application to a printing forme 30 of a forme cylinder 11 via the ink application rollers 12, 13 include:

c) one of the two ink application rollers 12 or 13 is brought out of contact with the forme cylinder 11 and the central roller 2. The following rollers remain in contact:

16, or respectively 17, with the central roller 2 and the riding roller 29, or respectively 31, the riding rollers 29, or respectively 31, with the respective ink application roller 12, or respectively 13, assigned to them;

d) as in c), but the riding roller 29, or respectively 31, is taken out of contact with its adjoining rollers 16 and 12, or respectively 17 and 13, of the roller train 17-31-13, or respectively 16-29-12, whose ink application roller is not placed against the forme cylinder;

e) the first inking rollers 16, 17 are placed against the central roller 2, and the ink application rollers 12, 13 are placed against the forme cylinder 11. One or both riding rollers 29, 31 have been brought out of contact with the adjoining rollers 16 to 12.

The rollers 16-29-12, and 38 of the two above described embodiments of the first inking roller train 20 are pivotably arranged together around the axis of rotation 10 of the central cylinder 2. Spaced inner rockers 8, as seen in each of FIGS. 1–4, provide support for the first inking roller train 20.

The rollers 17-31-13, and 39 of the two above described embodiments of the second inking roller train 25 are pivotably arranged together around the axis of rotation 10 of the central cylinder 2. Spaced outer rockers 9, as seen in FIGS. 1–4, provide support for the second inking roller train 25.

Figure 2:
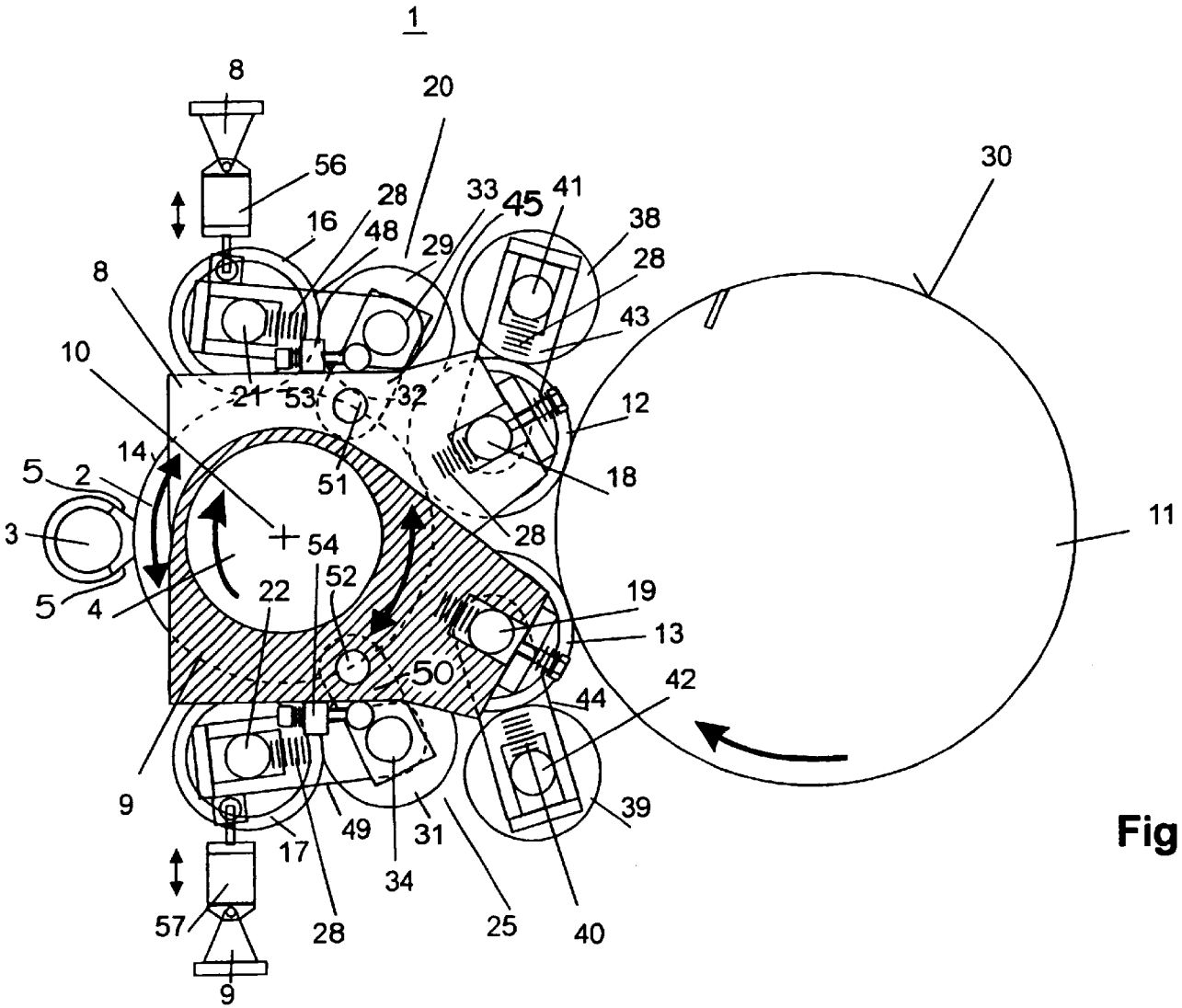
Figure 3:
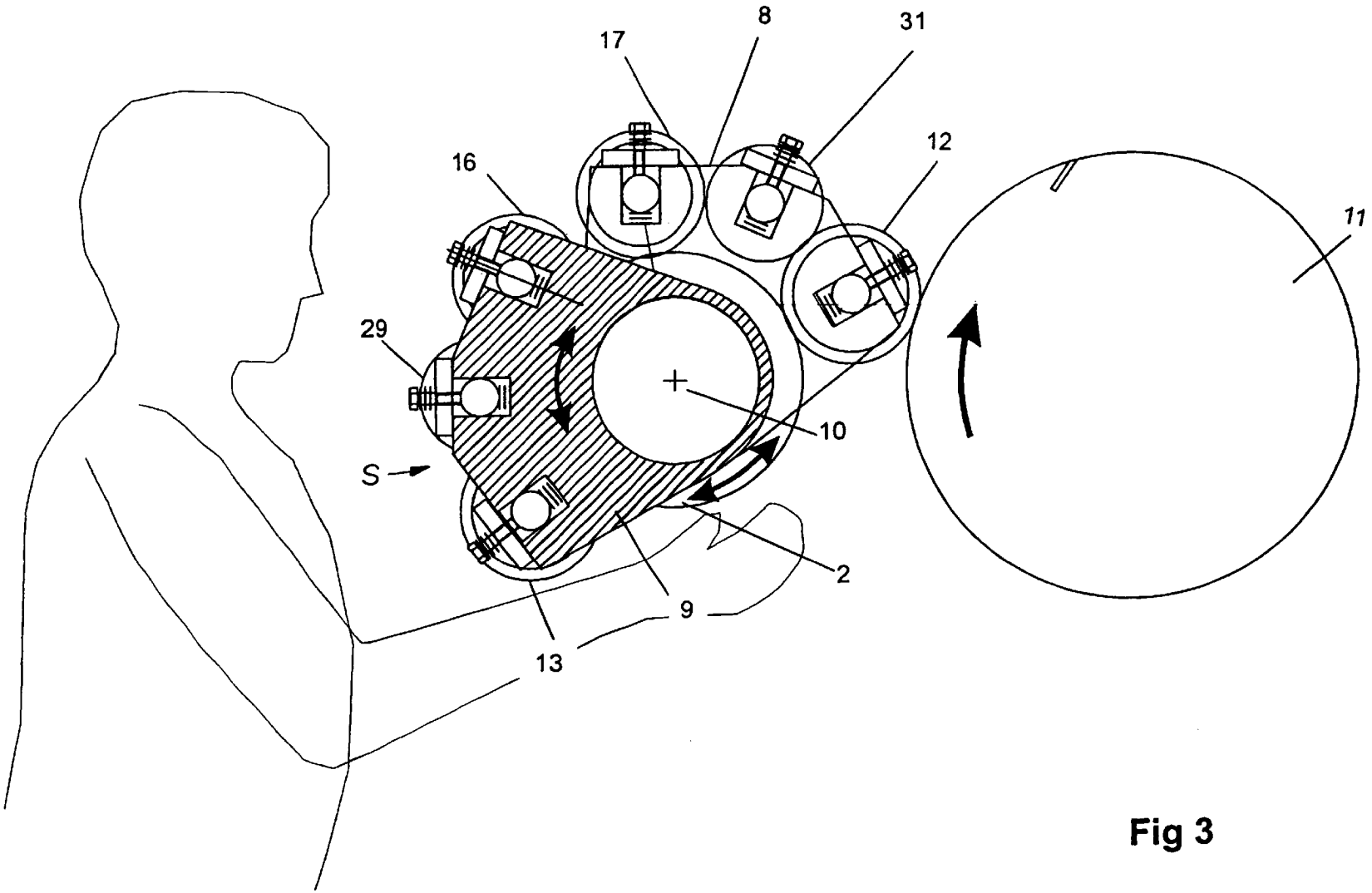

The roller(s) of both inking roller trains 20, 25 can be pivoted from their work position A, as seen in FIG. 1 around their axis of rotation 10 away from the forme cylinder 11 so far that they move from their nearly horizontal position as seen in FIG. 1 into a nearly vertical position (S), into a servicing position S, as seen in FIG. 3. They can be moved independently of each other and usefully sequentially. By means of this movement of each of the inking roller trains 25, 30 it is therefore possible to bring the rollers of one of the inking roller train 20, 25 into a position S defined as a servicing position, in which it is possible to adjust the position of the rollers in respect to each other and to the central roller 2. Prior to initiating the pivoting process for each inking roller train 20 or 25, the ink application device 3 has been removed out of the inking system 1. Space is made available by this removal of the ink application device 3 for the temporary access to the rollers 16, 29, 12, (38) of the first roller train 20, or to the rollers 17, 31, 13, (39) of the second roller train 25, all as may be seen in FIG. 3.

Following adjustment, the serviced one of the inking roller trains 25, 30 is pivoted back into a work position A and is fixed in place. In this position, at least one ink application roller 12, 13 rests against the forme cylinder 11 with the desired ink application roller strip width or thickness. By means of the just described measures, it is possible to realize an inking system 1 of low structural height and, in the case of employing chamber doctor blades, additionally also of little structural depth.

The rollers 16, 29, 12, (38) of the first inking roller train 20 are rotatably seated or supported, in the two inner rockers 8, as seen in FIG. 2, which inner rockers 8 are spaced apart from each other, and are adjustable. The two inner rockers 8 are arranged axially spaced apart from each other and are connected with each other fixed against relative rotation. They are together arranged, pivotable around the axis of rotation 10 of the roller 2 in such a way that the rollers 16, 29, 12, (38) can move into the above described "servicing position S". In the described preferred embodiment, the two inner rockers 8 are each pivotably seated on a bushing, which in turn is seated in bores in the lateral frames 55. In both the work and servicing positions of the first inking roller train 20, the rockers 8 can be locked, fixed in place in the lateral frames 55.

At least one of the ink application rollers 12, 13 is placed against the forme cylinder 11 in the "work position A" of the two pairs of rockers 8, 9.

In the "servicing position S", either the inner rocker pair 8 with all its rollers 16, 29, 12, 38, or the outer rocker pair 9 with all its rollers 17, 31, 13, 39 have been pivoted away from the cylinder 11 around the axis of rotation 10, for example by 50°. In this "servicing position S", as depicted in FIG. 3, all rollers of the inking roller trains 20 or 25 carried by the pivoted-away rocker pairs 8 or 9, respectively are then practically freely accessible to an operator. This means that the rollers can be removed without obstacles from the inking system, or can be newly installed and adjusted with respect to each other.

Subsequently the rocker pair 8 or 9 is pivoted back into its "work position" and is locked, fixed in the lateral frame 55. A pivot angle of better than 30° such as, for example of 45° to 180° is possible for each inking roller train 20 or 25.

The rollers 17, 31, 13 and if provided, also a riding roller 39 on the ink application roller 13 of the second inking roller train 25 are rotatably seated in the two outer rockers 9, which are axially spaced from each other and which are connected with each other, fixed against relative rotation. "Outer" means, that the outer rockers 9 are close to the lateral frame 55. "Inner rockers 8" means, that these rockers 8 can be pivoted about the axis of rotation 10 between the two outer rockers 9.

The above mentioned bushings, not represented, which support the inner rockers 8 and the outer rockers 9 are arranged concentrically in respect to the axis of rotation 10 and to the bores in the lateral frames 55. The two roller journals 4 of the central, oleophilic ink receiving roller 2 are rotatably seated in these bores. The drive, for example a gear, a direct drive by an electric motor, etc. of the roller 2 takes place via one of the two roller journals 4. The pivoting movements of both pairs of rockers 8, 9 can take place manually, but can also be accomplished by means of other drive mechanisms, for example gears, gear wheels, coupling gears, traction mechanism gears, etc., or other types of gears.

The diameter of the central roller 2 can be equal to, greater, or less than the diameter of the rollers 12, 16, 29, or respectively 13, 17, 31. This diameter of the central roller 2 corresponds to a not whole number multiple of the diameters of rollers 12, 16, 29; or 13, 17, 31. The rollers 12, 16, 29; or 13, 17, 31 can all have diameters which are different from each other.

The two roller journals 18, 14, 21 of each of the rollers 12, 29, 16, and possibly also of additional rollers, are arranged, displaceable and adjustable against compression springs 28, in guides 23, 6, 26 which are oriented in the direction toward the surface of the roller 2. The guides 23, 6, 26 are respectively provided in both of the inner rockers 8.

The two roller journals 19, 34, 22 of the rollers 13, 31, 16, and possibly of additional rollers are arranged, displaceable and adjustable in guides 24, 7, 27, which are oriented in the direction toward the surface of the roller 2. The guides 24, 7, 27 are respectively provided in both rockers 9 of the outer rockers.

Depending on whether printing is to be performed in accordance with a wet or dry offset process, a dampening system, not represented, can be provided or dispensed with.

In the second preferred embodiment, as depicted in FIG. 2, still another or second riding roller 38, 39 acting on the ink application roller 12, 13, as seen in FIG. 2, is additionally in contact with each ink application roller 12, 13. The roller journals 41, 42 of the respective second riding rollers 38, 39 are rotatably fastened in the respective ends of a pair of holding aims 43, or 44, on the rockers 8 or 9, respectively. The second riding roller 38 or 39 is pulled, or pushed, against the surface of the ink application roller 12, 13 respectively by an extension or compression spring 28. The second riding rollers 38, 39 have a hard, oleophilic surface of plastic or metal, for example, and can also be embodied to move axially back and forth.

As already mentioned above, the inking roller 16 or 17, which is in contact with the first riding roller 29 or 31, is arranged so it can be engaged with or disengaged from the roller 2, as depicted in FIG. 2. For this purpose, the roller journals 21, 22 of the inking rollers 16, 17 and the roller journals 33, 34 of the first riding rollers 29, 31 are supported in pivotable pairs of brackets 48 and 49; or 45 and 50, respectively, which are brackets made of heavy plate. The roller journals 33, 34 are maintained in the outer ends of the pairs of brackets 45, 50. The other ends of the pairs of brackets 45, 50 are seated in a pivotable and adjustable manner on the rockers 8, or respectively 9.

The ends of the pairs of brackets 48, 49 and the ends of the pairs of brackets 45, 50 are rotatably seated on the roller journals 33, 34 of the first riding rollers 29, 31.

The pairs of brackets 45, 50 are each arranged so they can be finely adjusted in respect to the pivot arms 51, 52 by means of adjusting screws 53, 54. The inking rollers 16, 17 are pushed by means of springs 28—for example compression springs—against the first riding roller 29, or respectively 31. The first riding rollers 29, 31 are pushed against the surfaces of the inking rollers 16 and 12, or respectively 17 and 13, by means of springs 32. The ends of the pairs of brackets 48, 49 which are remote from the riding rollers 29 and 31 are respectively hingedly connected with a fork head of a work cylinder 56, 57.

The opposed bearings of the work cylinders 56, 57 are respectively fastened on a narrow side of the rockers 8, or respectively 9.

The inking rollers 16, or respectively 17, are brought out of contact with the central roller 2 by the actuation of the work cylinders 56, 57. However, they remain in contact with the riding rollers 29, 31, and the latter, in turn, remain in contact with the ink application rollers 12, 13. The ink application roller 12 is in contact with the central roller 2, as well as with the second riding roller 38, 39, and the forme cylinder 17, all as may be seen in FIG. 2.

It is also possible to make the second riding rollers 38, 39 so they can be engaged with, or disengaged from the ink application rollers 12, 13, which are assigned to them.

However, the two inking roller trains 20 and 25 can also have more than two oleophilic rollers 16, 12, or respectively 17, 13, which can be brought into direct contact with the surface of the central roller 2, and more than two riding rollers 29, 31 per roller train can also be provided.

The following applies to both preferred embodiments:

At least one riding roller 29, 31 having, for example, a hard oleophilic surface, made of a plastic material, "Rilsan", for example, is respectively pivotably arranged on the rocker 8, 9 between each ink application roller 12, 13 and the inking roller 16, 17. Each riding roller 29, 31 is pushed, by the force of spring 32, supported on the rockers 8, 9, against the surfaces of the ink application roller 12, or respectively 13, and the inking roller 16, or respectively 17 as seen in FIG. 1. In FIG. 2, the shaft journals 33, 34 of the riding rollers 29, 31 are respectively seated on first ends of pivotably seated pivot arms 45, 50. The second ends of the pivot aims 45, 50 are hinged to the rockers 8, 9. All or some rollers of both inking roller trains 20, 25 can be designed to be moving back and forth axially, i.e. as distributing rollers.

Both pairs of rockers 8, 9 are seated, pivotable around the axis of rotation 10 of the ink receiving roller 2, by means of schematically represented drives 46, 47 which are shown in FIG. 1. The opposed bearings of the drives 46, 47 are supported on the two lateral frames 55 of the inking system 1. Besides dual-acting work cylinders, it is also possible to employ gear motors as the drives 46, 47 for the pivotable pairs of rockers 8 and 9.

In this case, the inner rockers 8, or respectively the outer rockers 9, which are rigidly connected with each other, are each equipped with a hub having a bore. The two hubs of the outer rockers 9 are rotatably seated in bores in the lateral frames 55. The two hubs of the inner rockers 8 are seated in the two hubs of the outer rockers 9. Respectively, one of the hubs of the inner and outer rockers 8, 9 is provided with teeth on the outside. These are respectively in connection, with or without traction mechanisms, with the teeth of a drive motor.

The roller journals 4 of the ink receiving roller 2 are rotatably and driveably seated in the bores of the hubs of the inner rockers 8.

Figure 4:
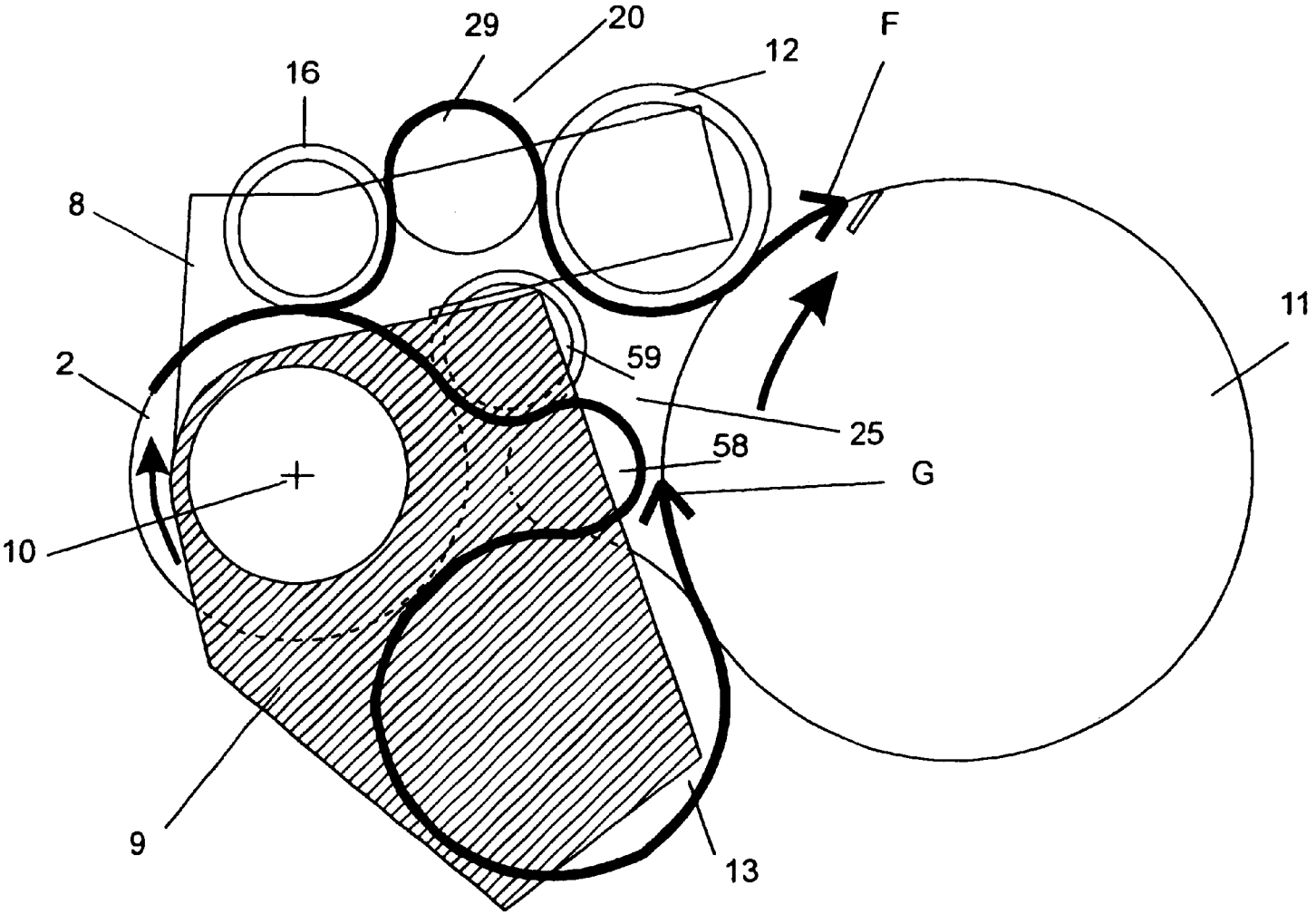

In the preferred embodiment represented in FIG. 4, the three rollers 16, 29, 12 of the first inking roller train 20 are arranged, switched "in series", or "in line" on the rocker pair 8. A "series flow of ink" F is created, i.e. the roller 16 is in contact with the roller 2. The ink application roller 12 is in contact with the forme cylinder 11. The riding roller 29 is in contact with the rollers 16 and 12. From the roller 2 an "in series" or "in line" ink flow F results from the roller 2 to the roller 16->via the riding roller 29->via the ink application roller 12 and onto the forme 30 of the forme cylinder 11.

Ink is brought from the central roller 2 to the second ink application roller 13 via the ink flow bypass G. For this purpose, an inking roller 59 with an oleophilic sheath is in contact with the surface of the central roller 2 and with an oleophilic sheath of a riding roller 58. The rollers mentioned in connection with this preferred embodiment are engaged with, or disengaged from each other in the same way as described in the first preferred embodiment. The same applies to the pivotability of the pairs of rockers 8, 9.

While preferred embodiments of an inking unit in accordance with the present invention have been set forth fully and completely herein above, it will be apparent to one of skill in the art that a number of changes in, for example the type of ink being used, the specific drive assembly for the forme cylinder and the like could be made without departing from the true spirit and scope of the present invention which is accordingly to be limited only by the following claims.

What is claimed:

1. An inking system in a rotary printing press comprising:

first and second ink application rollers, each of said first and second ink application rollers being engageable with a forme cylinder of the rotary printing press;

a central, ink-conducting roller, at least one of said first and second ink application rollers being directly in contact with said central ink-conducting roller;

means continuously supplying ink to said central, ink-conducting roller; and first and second ink roller trains contacting said central ink-conducting roller, said first and second ink roller trains indirectly inking said first and second ink application rollers with ink from said central ink-conducting roller.

2. An inking system of a rotary printing press comprising:

a central roller supported for rotation in a production direction of the rotary printing press;

means continuously supplying ink to said central roller;

first and second ink application rollers, at least one of said first and second ink application rollers receiving ink directly from said central roller;

first and second ink roller trains contacting said central roller;

a first bypass ink flow supplied by said central roller to said first ink application roller, through said first ink roller train; and a second bypass ink flow supplied by said central roller to said second ink application roller, through said second ink roller train.

3. The inking system of claim 2 wherein said first and second bypass ink flows can be selectively turned on and off.

4. The inking system of claim 2 wherein said first and second bypass ink flows can be selectively interrupted.

5. An inking system of a rotary printing press comprising:

a central roller supported for rotation in a production direction of the rotary printing press;

means continuously supplying ink to said central roller;

first and second ink application rollers, at least one of said first and second ink application rollers receiving ink directly from said central roller;

first and second ink roller trains contacting said central roller;

a first in series ink flow supplied by said central roller to said first ink application roller viewed in said production rotation direction of said central roller from said first ink roller train; and a second bypass ink flow supplied by said central roller to said second ink application roller viewed in a direction opposite to said production rotation direction from said second ink roller train.

6. The inking system of claim 5 wherein said first in series ink flow and said second bypass ink flow can be selectively turned on and off.

7. The inking system of claim 5 wherein said first in series ink flow and said second bypass ink flow can be selectively interrupted.

8. An inking system for a rotary printing press comprising:

a central roller supported for rotation about an axis of rotation means to deliver ink to said central roller;

a first ink application roller in contact with said central roller a pair of spaced rockers supported for pivotal movement between a work position and a service position through an angle of between 45° and 180° about said central roller axis of rotation;

means supporting said first ink application roller for rotation on said pair of rockers, said first ink application roller contacting a forme cylinder in said work position of said rockers and being out of contact with the forme cylinder in said service position; and inking rollers acting together with said first ink application roller and being rotatably supported on said pair of rockers.

9. The inking system of claim 8 further including a second ink application roller, said second ink application roller being supported for pivotal movement about said central roller axis of rotation between said work position and said service position.

10. The inking system of claim 9 wherein said first and second ink application rollers are pivotable independently of each other.

11. An inking system in a rotary printing press comprising:

a central roller;

means to supply ink to said central roller;

first and second ink application rollers engageable with a forme cylinder of the rotary printing press, at least one of said ink application rollers receiving ink directly from said central roller;

a first ink roller train connecting said first ink application roller and said central roller; and a second ink train connecting said second ink application roller and said central roller.

12. The inking system of claim 11 wherein each of said first and second ink application rollers is supported for independent pivotal movement with respect to the forme cylinder.

13. The inking system of claim 12 further including a pair of rockers pivotable about an axis of rotation of said central roller, said first ink application roller being rotatably supported in said pair of rockers.

14. The inking system of claim 13 further including inking rollers and riding rollers rotatably supported by said pair of rockers.

15. The inking system of claim 14 wherein said inking rollers can be selectively engaged with, and disengaged from said central roller.

16. The inking system of claim 15 wherein said riding roller is engagable with said inking roller and said ink application roller in each said ink roller train.

17. The inking system of claim 15 wherein said riding roller is engageable with, and disengageable from said inking roller, and is disengageable from said ink application roller in each said ink roller train.

18. The inking system of claim 15 wherein said riding roller is engageable with, and disengageable from said ink application roller and is disengageable from said inking roller in each said ink roller train.

19. The inking system of claim 11 wherein said first and second ink roller trains can be selectively engaged with, and disengaged from said central roller.

* * * * *